US007913742B2

(12) United States Patent
Newcomb

(10) Patent No.: US 7,913,742 B2
(45) Date of Patent: Mar. 29, 2011

(54) INTEGRAL BLOW TUBE AND TAMPING PIN

(75) Inventor: Thomas P Newcomb, Defiance, OH (US)

(73) Assignee: GM Global Technology Operations LLC, Detroit, MI (US)

( * ) Notice: Subject to any disclaimer, the term of this patent is extended or adjusted under 35 U.S.C. 154(b) by 373 days.

(21) Appl. No.: 12/146,914

(22) Filed: Jun. 26, 2008

(65) Prior Publication Data

US 2009/0321984 A1 Dec. 31, 2009

(51) Int. Cl.
*B22C 15/24* (2006.01)

(52) U.S. Cl. ..... 164/22; 164/16; 164/200

(58) Field of Classification Search ..... 164/16, 164/19–22, 200–202
See application file for complete search history.

(56) References Cited

U.S. PATENT DOCUMENTS

| | | | | |
|---|---|---|---|---|
| 3,530,928 | A * | 9/1970 | Swinney | 164/201 |
| 4,836,269 | A * | 6/1989 | Bellis et al. | 164/200 |
| 5,911,267 | A * | 6/1999 | Witte et al. | 164/12 |
| 7,284,588 | B2 | 10/2007 | Senk, Jr. et al. | |
| 2004/0211537 | A1 * | 10/2004 | Senk et al. | 164/21 |

FOREIGN PATENT DOCUMENTS

JP 54-107429 * 8/1979

* cited by examiner

*Primary Examiner* — Kuang Lin
(74) *Attorney, Agent, or Firm* — Fraser Clemens; Martin & Miller LLC; J. Douglas Miller

(57) ABSTRACT

An apparatus for the forming of sand cores adapted to convey sand, tamp a sand core, and militate against an undesirable exposure of uncured sand to catalyst gases, while providing a non-tortuous flow path for sand. The apparatus for the forming of sand cores comprises a core box, a gassing manifold, a blow tube, a sand magazine, a connector tube, and a tamping pin.

20 Claims, 2 Drawing Sheets

INTEGRAL BLOW TUBE AND TAMPING PIN

FIELD OF THE INVENTION

The invention relates to foundry equipment and more particularly to a method for forming sand cores used in casting of metal parts.

BACKGROUND OF THE INVENTION

Sand cores are commonly used within the foundry industry in the production of metal castings having complex interior and exterior geometry. These metal castings are formed by pouring molten metal around or into the sand core. After the casting process, the metal casting is extracted by destructively removing the sand core. Specifically, the metal casting is extracted by breaking the sand core or shaking the sand out of the casting. Hence, the casting of metal parts can require the use of one or more sand cores that correspond to the part geometry that is to be cast.

In general, the sand cores are formed in a core box. The core box typically includes two halves which cooperate to define a volume having the geometry of a desired sand core. Sand to be formed enters the core box through one or more blow tubes, which allow passage from a sand reservoir or magazine to the hollow interior of the core box. Before entering the magazine, the sand is coated with a liquid binder, often referred to as resin. The sand is conveyed from the magazine into the core box, via the blow tubes, by pressurizing the magazine with compressed air. Air is able to escape from the core box during the forming of the sand core through narrow vent passages in the core box.

In addition to filling the core box with sand, other steps are necessary before the desired sand core is completed. To refine the sand core shape before it is hardened, tamping may be used at the blow tube locations. Tamping involves flattening the residual sand at the blow tube locations to allow the sand core to best resemble the desired geometry. In past methods, tamping is accomplished by moving the magazine and blow tubes away from the core box, and subsequent positioning of a gassing head with tamping mechanisms over the core box. Tamping pins that correspond to the shape and location of the blow tubes are lowered into the blow tubes locations by a relative movement between the tamping mechanism, where the tamping pins are mounted, and the core box. Upon completion of the tamping, the catalyst gas is introduced to the sand core to cause a solidification thereof. The gas is introduced to the sand core via a gassing manifold encompassing the blow tube openings and the vents in the upper side of the core box. The gases exit the core box through vents in the lower side of the core box. After a suitable curing time, the core box is purged with air to remove any residual catalyst vapor. To complete the process, the core box halves are separated and the finished sand core is removed from the core box.

Recently, methods have been proposed that require complex blow tubes to facilitate the multiple functions of sand conveyance, tamping, sealing of the blow tube, and catalyst gas and purge air conveyance. U.S. Pat. No. 7,284,588 B2, hereby incorporated herein by reference in its entirety, discloses a complex blow tube that eliminates the need to interchange the sand magazine and gassing manifold during the machine cycle. This invention provides substantial advantages in terms of equipment cost and cycle time. However, the integration of separate conduits used for the conveyance of the sand and catalyst gas into the tamping pin and the necessity of maintaining adequate sealing is the source of disadvantages for this method. Examples of these disadvantages are the creation of a complex and tortuous flow path for the sand, a high risk of catalyst leakage causing blow tube plugging, laborious and costly cleaning of plugged blow tubes, and numerous rubber O-rings that are prone to fail with repeated use.

It would be desirable to have a sand core forming apparatus adapted to convey the sand, tamp the sand, and militate against an undesirable exposure of uncured sand residing within the blow tube to catalyst gases, while providing a non-tortuous flow path for the sand.

SUMMARY OF THE INVENTION

Presently provided by the invention, a sand core forming apparatus tailored to convey the sand, tamp a sand core, and militate against the undesirable exposure of uncured sand to catalyst gases, while providing a non-tortuous flow path for the sand, has surprisingly been discovered.

In one embodiment, the sand core forming apparatus comprises a core box having a cavity formed therein; a gassing manifold in fluid communication with said core box; a blow tube having a resilient tip in fluid communication with the cavity of said core box; a sand magazine having a sand reservoir formed therein; a connector tube providing fluid communication between the reservoir of said sand magazine and the cavity of said core box; and a tamping pin coupled to said sand magazine, wherein said tamping pin cooperates with the resilient tip to selectively control flow of sand from said sand magazine to the cavity of said core box.

In another embodiment, the sand core forming apparatus comprises a core box having a cavity formed therein; a gassing manifold in fluid communication with said core box; a blow tube having a resilient tip in fluid communication with the cavity of said core box; a sand magazine having a sand reservoir formed therein; a connector tube providing fluid communication between the reservoir of said sand magazine and the cavity of said core box; and a tamping pin coupled to said sand magazine by one or more supporting legs, wherein said tamping pin cooperates with the resilient tip to selectively control flow of sand from said sand magazine to the cavity of said core box.

The invention also provides methods for the forming of sand cores.

In one embodiment, the method for the forming of sand cores comprises the steps of providing a core box having a cavity formed therein; providing a gassing manifold in fluid communication with said core box; providing a blow tube in fluid communication with the cavity of said core box; providing a sand magazine having a sand reservoir formed therein; providing a connector tube affording fluid communication between the reservoir of said sand magazine and the cavity of said core box; and providing a tamping pin coupled to said sand magazine, wherein the tamping pin cooperates with the resilient tip to selectively control flow of sand from said sand magazine to the cavity of said core box; filling the cavity of said core box with sand; wherein sand is introduced to the cavity through said blow tube; tamping the sand core with said tamping pin, wherein the tamping is performed by a movement of said sand magazine; sealing the blow tube with said tamping pin, wherein the sealing is performed by a movement of said sand magazine; and introducing a catalyst to the sand core through at least one venting location in said core box.

The sand core forming apparatus provided by the present invention is specifically advantageous for providing a non-tortuous flow path for sand, militating against an undesirable exposure of uncured sand to catalyst gases, tamping the sand core, and conveying sand.

BRIEF DESCRIPTION OF THE DRAWINGS

The above, as well as other advantages of the present invention, will become readily apparent to those skilled in the art from the following detailed description of embodiments of the invention when considered in the light of the accompanying drawings in which.

DETAILED DESCRIPTION OF EXEMPLARY EMBODIMENTS OF THE INVENTION

The following detailed description and appended drawings describe and illustrate an embodiment of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
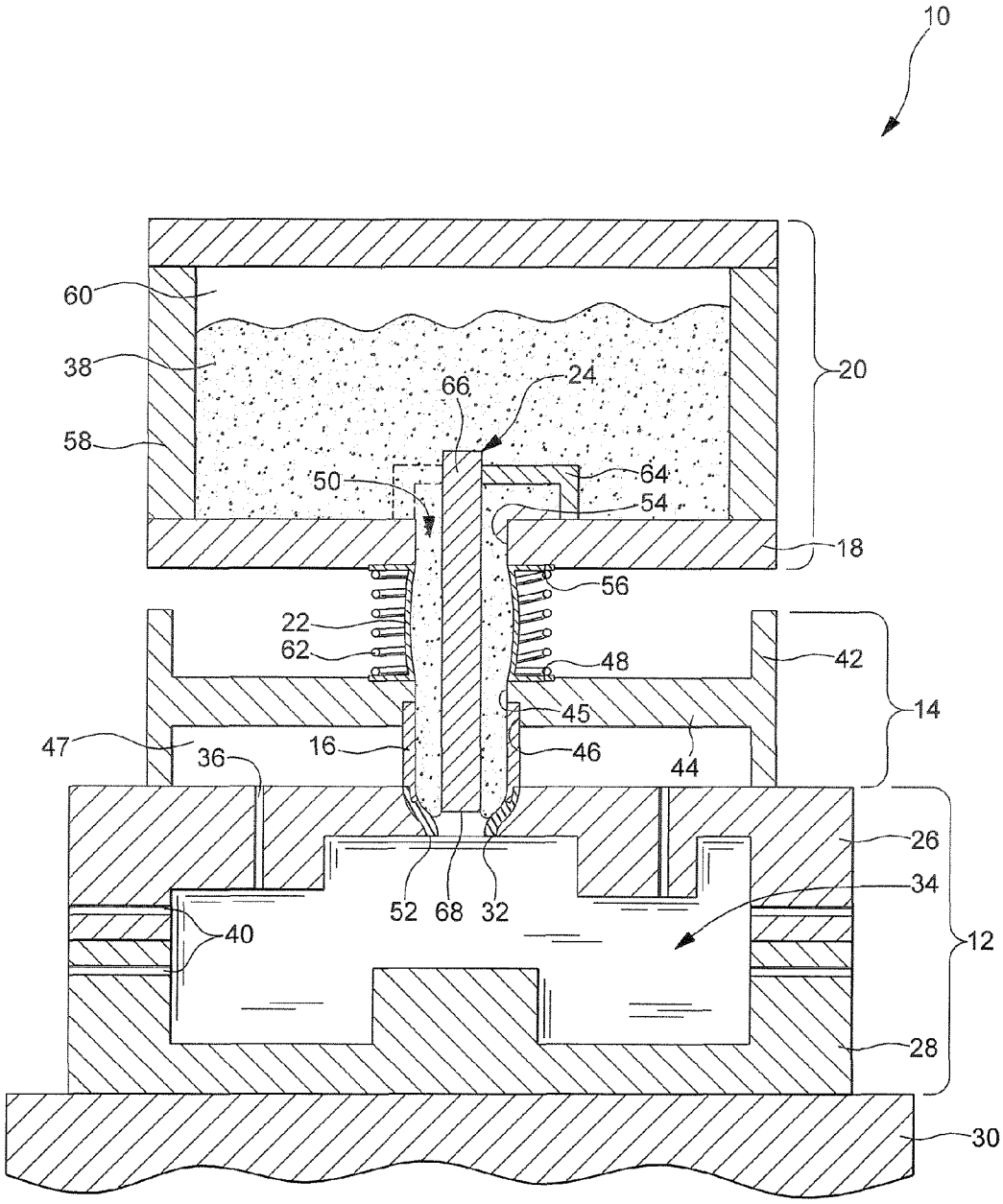
FIG. 1 is a schematic side cross sectional view of a sand core forming apparatus according to the present invention, the apparatus being shown in a position of sand conveyance.

FIG. 1 illustrates a sand core forming apparatus 10 according to an embodiment of the invention. The sand core forming apparatus 10 includes a core box 12, a gassing manifold 14, a blow tube 16, a blow plate 18, a sand magazine 20, a connector tube 22, and a tamping pin 24. The core box 12 is made from a durable material such as steel, that can be machined accurately. The core box 12 consists of a cover 26 and a box 28, where the box 28 is the bottom of the core box 12. A horizontally parted core box 12 is shown. However, the apparatus 10 could be used with a vertically parted core box as well. The assembled cover 26 and box 28 rest on a supporting surface 30, which provides for movement of the core box 12 during removal of the finished core. The core box 12 has an aperture 32 formed in the cover 26 in communication with a cavity 34 formed between the cover 26 and the box 28. A shape of the cavity 34 corresponds to a shape of the sand core that is desired. The aperture 32 formed in the cover 26 allows the blow tube 16 to sealingly engage the core box 12 in a manner so the blow tube 16 is substantially aligned with an inner surface of the core box 12 forming the cavity 34. Passages 36 are provided in the cover 26 to allow air to escape the core box 12 as it is filled with the sand 38 and to allow a catalyst gas to be introduced to the core box 12 as well. Vents 40 are also located on the cover 26 and the box 28, which allow air to escape the core box 12 as it is filled with the sand 38.

The gassing manifold 14 is made from a durable material such as steel, and is made to correspond with the shape of the core box 12. The gassing manifold 14 includes side wall members 42 and an upper wall member 44 disposed intermediate a height of the wall members 42. The upper wall member 44 has an aperture 45, formed therein and substantially aligned with the aperture 32 formed in the core box 12. The aperture 45, defined at least partially by an inner wall 46, may be threaded as a means of attaching the blow tube 16 to the gassing manifold 14. A volume between the upper wall member 44 and core box 12, forms a manifold chamber 47. The upper wall member 44 may also include a counter bore 48, concentric with the aperture 45, as a means of locating and securing a position of the collapsible connector tube 22. The gassing manifold 14 is selectively secured to the core box 12 by any conventional means such as clamping, and can be disengaged from the core box 12 to allow the core box 12 to be removed from the sand core forming apparatus 10.

The blow tube 16 is made from a durable material such as steel, and is adapted to be coupled to the gassing manifold 14. The blow tube 16 is hollow, forming a portion of a conveyance cavity 50, through which the sand 38 is conveyed. A resilient tip 52 is disposed on an end of the blow tube 16, to allow the blow tube 16 to sealingly engage walls forming the aperture 32 when the sand core forming apparatus 10 is in a position of sand conveyance. The blow tube 16 has a length appropriate to allow the blow tube 16 to engage the aperture 32 when the gassing manifold 14 is secured to the core box 12.

The blow plate 18 is made from a durable material such as steel. An aperture 54 is formed in the blow plate 18 and is substantially aligned with the aperture 32 and the aperture 45. The blow plate 18 is disposed adjacent the gassing manifold 14 and has a first and a second position. The first position, illustrated in FIG. 1, is a position of sand conveyance. In the first position, the blow plate 18 does not contact the gassing manifold 14. In the second position, the blow plate 18 abuts the gassing manifold 14. The blow plate 18 also includes a counter bore 56, concentric with the aperture 54, the counter bore 56 facilitates a locating and a securing of the collapsible connector tube 22.

The sand magazine 20 includes wall members 58 that abut the blow plate 18. The wall members 58 may be made from any conventional material, such as steel. A cavity 60 is formed between the wall members 58 and the blow plate 18. The cavity 60 provides a location for the sand 38 to be stored and pressurized before being conveyed to the core box 12.

The connector tube 22 is typically formed from a resilient material, such as plastic. The connector tube 22 is disposed between the upper wall member 44 and the blow plate 18, and is substantially aligned with the aperture 45. A portion of the conveyance cavity 50 is formed by the connector tube 22. Annulets are formed on each end of the connector tube 22. The annulets militate against a leakage of the sand 38 from the conveyance cavity 50. In the embodiment shown, the connector tube 22 is collapsible, thereby allowing a deformation of the connector tube 22. A tension device 62 is disposed on the connector tube 22, the tension device being a coil spring 62. Other tension devices, such as a leaf spring or resilient rubber could be employed as desired.

Figure 2:
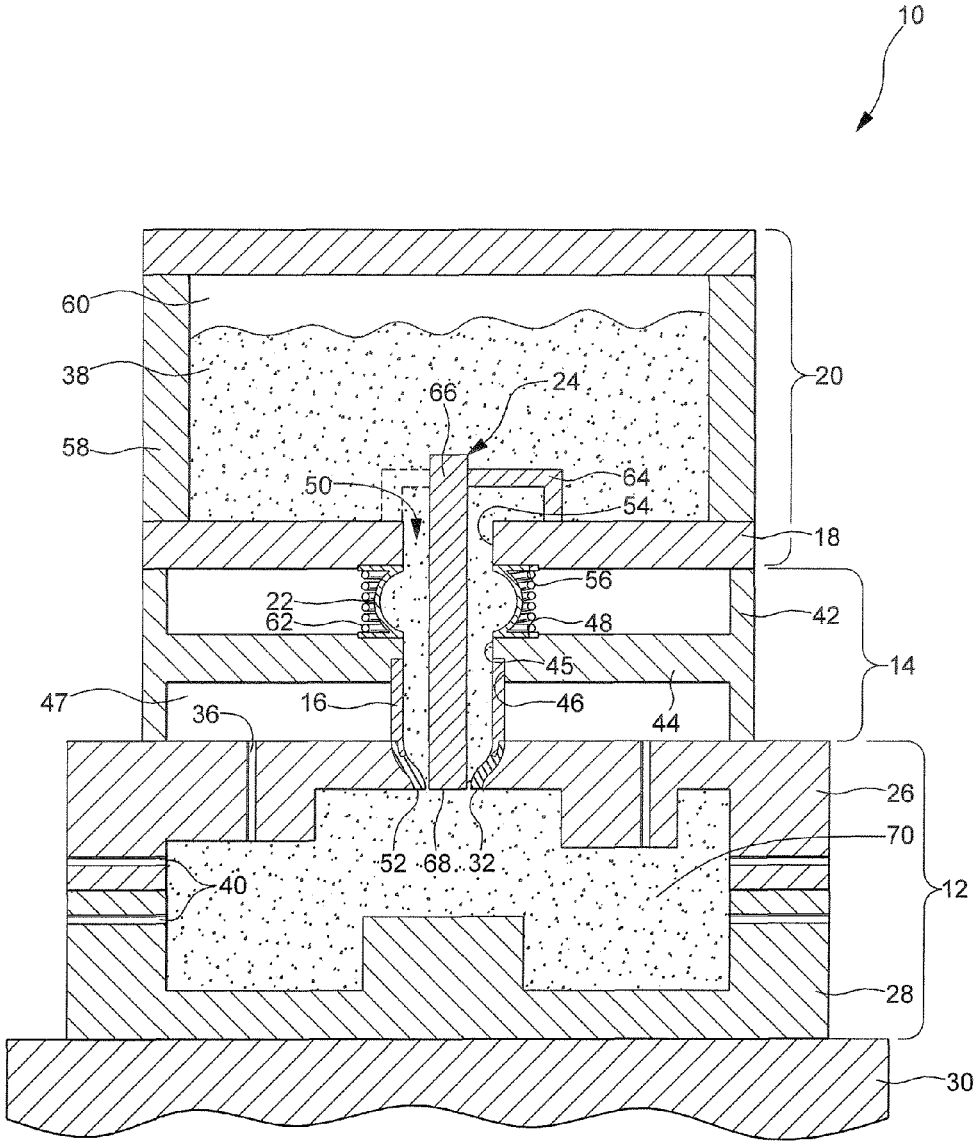
FIG. 2 is a schematic side cross sectional view of the sand core forming apparatus of FIG. 1, shown in a position of catalyst introduction.

The tamping pin 24 is made from a durable material such as steel, and is coupled to the blow plate 18. The tamping pin 24 may be coupled by any conventional means, such as welding or fastening. In the embodiment shown, the tamping pin 24, has supporting legs 64, interconnecting the tamping pin 24 and the blow plate 18. The tamping pin 24 includes a central cylinder 66, which is attached to the supporting legs 64 by any conventional means, such as welding, fastening, or a press fit. The supporting legs 64 may be individually attached or may be attached simultaneously through the use of a central hub, which receives the central cylinder 66. The central cylinder 66 is received in the aperture 54, the connector tube 22, the aperture 45, and the blow tube 16. In the embodiment shown, the tamping pin 24 is a solid cylinder and has three supporting legs 64, substantially "L" shaped. As illustrated in FIG. 1, when the blow plate 18 is in a first position of sand conveyance, the central cylinder 66 has a length that allows sand 38 to flow freely through the conveyance cavity 50, around the central cylinder 66, and into the cavity 34 in the core box 12. As illustrated in FIG. 2, when the blow plate 18 is in a second position of catalyst introduction, the central cylinder 66 performs a tamping and sealing function. The central cylinder 66 has a tamping surface 68 which performs a tamping function when the blow plate 18 is moved from the first position to the second position. The central cylinder 66 also militates against an introduction of catalyst gasses to the blow tube 16 when the blow plate 18 is in the second position.

FIG. 2 illustrates the sand core forming apparatus 10 in the second position of catalyst introduction, where the core box 12 has been filled with the sand 38. The second position is achieved by the blow plate 18 moving into contact with the gassing manifold 14. The core box 12, having the aperture 32 sealed by the central cylinder 66 of the tamping pin 24, can be exposed to a catalyst. The movement of the blow plate 18 to the second position also causes the connector tube 22 to be elastically deformed. The catalyst is released in the manifold chamber 47 and enters the cavity 34 through the apertures 36, which exposes the uncured sand core 70 thereto. Pressurization of the sand magazine 20, at either the same pressure of the gassing manifold or slightly greater at this time by air may be used to militate against an introduction of catalyst gases into the blow tube 16 from the core box 12. After an appropriate curing time, the manifold chamber 47 is purged with air to remove any remaining catalyst, ending the core hardening process. The box 28 is then lowered from the cover 26. The cured sand core can then be removed. The box 28 is then raised to the cover 26. The sand core forming apparatus 10 is then returned to a position of sand conveyance by a movement of the blow plate 18. The core making cycle can then be repeated.

From the foregoing description, one ordinarily skilled in the art can easily ascertain the essential characteristics of this invention and, without departing from the spirit and scope thereof, make various changes and modifications to the invention to adapt it to various usages and conditions.

I claim:

1. An apparatus for the forming of a sand core, comprising:

a core box having a cavity formed therein corresponding to a shape of a desired sand core;

a gassing manifold in fluid communication with said core box, wherein said gassing manifold includes an upper wall member;

a blow tube in fluid communication with the cavity of said core box, said blow tube disposed between the upper wall member of said gassing manifold and said core box;

a sand magazine having a sand reservoir formed therein;

a connector tube providing fluid communication between the reservoir of said sand magazine and said blow tube, said connector tube disposed between said sand magazine and the upper wall member of said gassing manifold; and a tamping pin coupled to said sand magazine, wherein said tamping pin cooperates with said blow tube to selectively control flow of sand from said sand magazine to the cavity of said core box.

2. The apparatus for the forming of sand cores according to claim 1, wherein said sand magazine includes a blow plate forming a bottom wall of said sand magazine, wherein said tamping pin is coupled thereto.

3. The apparatus for the forming of a sand core according to claim 1, wherein a movement between said sand magazine and said gassing manifold converts the apparatus from a position that permits sand flow from the sand reservoir to said core box to a position where said sand magazine sealingly engages said tamping pin with said blow tube, militating against sand flow from said sand magazine to said core box, militating against an introduction of catalyst to said blow tube and tamping the sand shape in said core box.

4. The apparatus for the forming of sand cores according to claim 1, wherein said tamping pin is coupled to said sand magazine by one or more supporting legs, permitting sand conveyance from the sand reservoir to the cavity of said core box.

5. The apparatus for the forming of sand cores according to claim 1, wherein said tamping pin is coupled to said sand magazine by three supporting legs, permitting sand conveyance from the sand reservoir to the cavity of said core box.

6. The apparatus for the forming of sand cores according to claim 1, wherein said connector tube is a collapsible hollow cylinder produced from a resilient plastic having a first diameter, having two annulets of a second diameter greater than the first diameter, disposed at both ends of the hollow cylinder, wherein a tension device is disposed on the hollow cylinder.

7. The apparatus for the forming of sand cores according to claim 1, wherein an aperture in the upper wall member is concentric with a counter bore in the upper wall member, wherein the aperture is at least partially defined by an inner wall, the inner wall adapted for coupling to said blow tube.

8. The apparatus for the forming of sand cores according to claim 7, wherein said blow tube includes a resilient tip and an end adapted for coupling to the upper wall member.

9. An apparatus for the forming of a sand core, comprising:

a core box having a cavity formed therein corresponding to a shape of a desired sand core;

a gassing manifold in fluid communication with said core box, wherein said gassing manifold includes an upper wall member;

a blow tube in fluid communication with the cavity of said core box, said blow tube disposed between the upper wall member of said gassing manifold and said core box;

a sand magazine having a sand reservoir formed therein;

a connector tube providing fluid communication between the sand reservoir and said blow tube, said connector tube disposed between said sand magazine and the upper wall member of said gassing manifold; and a tamping pin coupled to said sand magazine by one or more supporting legs, wherein said tamping pin cooperates with said blow tube to selectively control flow of sand from the sand reservoir to the cavity of said core box.

10. The apparatus for the forming of sand cores according to claim 9, wherein said sand magazine includes a blow plate forming a bottom wall of said sand magazine, wherein said tamping pin is coupled thereto.

11. The apparatus for the forming of a sand core according to claim 9, wherein a movement between said sand magazine and said gassing manifold converts the apparatus from a position that permits sand flow from the sand reservoir to said core box to a position where said sand magazine sealingly engages said tamping pin with said blow tube, militating against sand flow from said sand magazine to said core box, militating against an introduction of catalyst to said blow tube and tamping the sand shape in said core box.

12. The apparatus for the forming of sand cores according to claim 9, wherein said tamping pin is coupled to said sand magazine by three supporting legs, permitting sand conveyance from the sand reservoir to the cavity of said core box.

13. The apparatus for the forming of sand cores according to claim 9, wherein said connector tube is a collapsible hollow cylinder produced from a resilient plastic having a first diameter, having two amulets of a second diameter greater than the first diameter, disposed at both ends of the hollow cylinder, wherein a tension device is disposed on the hollow cylinder.

14. The apparatus for the forming of sand cores according to claim 9, wherein an aperture in the upper wall member is concentric with a counter bore in the upper wall member, wherein the aperture is at least partially defined by an inner wall, the inner wall adapted for coupling to said blow tube.

15. The apparatus for the forming of sand cores according to claim 14, wherein said blow tube includes a resilient tip and an end adapted for coupling to the upper wall member.

16. A method for the forming of sand cores comprising the steps of:

providing a core box having a cavity formed therein corresponding to a shape of a desired sand core;

providing a gassing manifold in fluid communication with said core box, wherein said gassing manifold includes an upper wall member;

providing a blow tube in fluid communication with the cavity of said core box, said blow tube disposed between the upper wall member of said gassing manifold and said core box;

providing a sand magazine having a sand reservoir formed therein;

providing a connector tube affording fluid communication between the sand reservoir and said blow tube, said connector tube disposed between said sand magazine and the upper wall member of said gassing manifold;

providing a tamping pin coupled to said sand magazine, wherein said tamping pin cooperates with the blow tube to selectively control flow of sand from said sand magazine to the cavity of said core box;

filling the cavity of said core box with sand, wherein sand is introduced to the cavity through said blow tube;

tamping the sand core with said tamping pin, wherein the tamping is performed by a movement of said sand magazine;

sealing the blow tube with said tamping pin, wherein the sealing is performed by a movement of said sand magazine; and introducing a catalyst to the sand core through at least one venting location in said core box.

17. The method according to claim 16, wherein said sand magazine includes a blow plate forming a bottom wall of said sand magazine, wherein said tamping pin is coupled thereto.

18. A method according to claim 17, wherein said tamping pin is coupled to said sand magazine by one or more supporting legs, permitting sand conveyance from the sand reservoir to the cavity of said core box.

19. A method according to claim 17, wherein said connector tube is a collapsible hollow cylinder produced from a resilient plastic having a first diameter, having two annulets of a second diameter greater than the first diameter, disposed at both ends of the hollow cylinder, wherein a tension device is disposed on the hollow cylinder.

20. A method according to claim 17, wherein an aperture in the upper wall member is concentric with a counter bore in the upper wall member, wherein the aperture is at least partially defined by an inner wall, the inner wall adapted for coupling to said blow tube.

* * * * *